US008718306B2

(12) United States Patent
Gommel et al.

(10) Patent No.: US 8,718,306 B2
(45) Date of Patent: May 6, 2014

(54) HEARING DEVICE WITH A DETACHABLY COUPLED EARPIECE

(75) Inventors: Uli Gommel, Erlangen (DE); Thomas Lotter, Heroldsberg (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 469 days.

(21) Appl. No.: 13/025,382

(22) Filed: Feb. 11, 2011

(65) Prior Publication Data

US 2011/0194716 A1 Aug. 11, 2011

(30) Foreign Application Priority Data

Feb. 11, 2010 (DE) ..... 10 2010 007 610

(51) Int. Cl.
*H04R 25/00* (2006.01)

(52) U.S. Cl.
USPC ..... 381/324; 381/322; 381/329

(58) Field of Classification Search
CPC .... H04R 25/60; H04R 25/604; H04R 25/608; H04R 25/65; H04R 25/625
USPC ..... 381/312, 322, 324, 328, 329
See application file for complete search history.

(56) References Cited

U.S. PATENT DOCUMENTS

| | | | | |
|---|---|---|---|---|
| 217,355 | A | 7/1879 | Campbell | |
| 2005/0190939 | A1* | 9/2005 | Fretz | 381/312 |
| 2006/0104467 | A1 | 5/2006 | Aeschlimann et al. | |
| 2008/0144870 | A1* | 6/2008 | Oliveira et al. | 381/324 |
| 2008/0232628 | A1 | 9/2008 | Ho et al. | |
| 2008/0285782 | A1* | 11/2008 | Gommel et al. | 381/322 |
| 2009/0245558 | A1* | 10/2009 | Spaulding | 381/328 |
| 2010/0027825 | A1 | 2/2010 | Fickweiler et al. | |
| 2011/0019850 | A1 | 1/2011 | Ooi | |

FOREIGN PATENT DOCUMENTS

| | | | |
|---|---|---|---|
| CN | 1701633 | A | 11/2005 |
| CN | 101272639 | A | 9/2008 |
| DE | 20114121 | U1 | 1/2003 |
| DE | 202006006851 | U1 | 7/2006 |
| EP | 1993324 | A2 | 11/2008 |
| EP | 2152025 | A1 | 2/2010 |
| WO | 2009120149 | A1 | 10/2009 |

* cited by examiner

*Primary Examiner* — Jesse Elbin
(74) *Attorney, Agent, or Firm* — Laurence A. Greenberg; Werner H. Stemer; Ralph E. Locher

(57) ABSTRACT

In a hearing device or hearing aid, provision can be made for a sound tube or an in-the-ear loudspeaker to be held in an auditory canal of a user by an earpiece. To couple a sound tube to an earpiece, a connection element can be provided on the sound tube, which connection element can be connected to a connection element for the earpiece. This connection must be detachable so that a user can remove the earpiece from the sound tube. Nevertheless, it must be possible to transmit such a large force over the connection that the earpiece can once again be pulled out of the auditory canal. The object is to simplify a detachable connection for coupling an earpiece to a sound tube or an in-the-ear loudspeaker. Accordingly, the connection element for the earpiece is provided as an independent component, which is attached in or on the earpiece.

4 Claims, 4 Drawing Sheets

HEARING DEVICE WITH A DETACHABLY COUPLED EARPIECE

CROSS-REFERENCE TO RELATED APPLICATION

This application claims the priority, under 35 U.S.C. §119, of German application DE 10 2010 007 610.4, filed Feb. 11, 2010; the prior application is herewith incorporated by reference in its entirety.

BACKGROUND OF THE INVENTION

Field of the Invention

The invention relates to a hearing device, in which a sound tube or an in-the-ear loudspeaker is coupled to an earpiece. The coupling is made possible by a first and a second connection element, which are detachably interconnected. Here the first connection element is configured as a component of the sound tube or the in-the-ear loudspeaker. The second connection element is provided on the earpiece. A hearing device should, in particular, be understood to mean a hearing aid. However, the term also includes other portable acoustic equipment, such as headsets, headphones or the like.

Hearing aids are portable hearing devices used to support the hard of hearing. In order to make concessions for the numerous individual requirements, different types of hearing aids are provided, e.g. behind-the-ear (BTE) hearing aids, hearing aids with an external receiver (receiver in the canal [RIC]) and in-the-ear (ITE) hearing aids, for example concha hearing aids or canal hearing aids (ITE, CIC) as well. The hearing aids listed in an exemplary fashion are worn on the concha or in the auditory canal. Furthermore, bone conduction hearing aids, implantable or vibrotactile hearing aids are also commercially available. In this case, the damaged sense of hearing is stimulated either mechanically or electrically.

In principle, the main components of hearing aids are an input transducer, an amplifier and an output transducer. In general, the input transducer is a sound receiver, e.g. a microphone, and/or an electromagnetic receiver, e.g. an induction coil. The output transducer is usually configured as an electroacoustic transducer, e.g. a miniaturized loudspeaker, or as an electromechanical transducer, e.g. a bone conduction receiver. The amplifier is usually integrated into a signal-processing unit. This basic configuration is illustrated in FIG. 1 using the example of a behind-the-ear hearing aid. One or more microphones 2 for recording the sound from the surroundings is/are installed in a hearing-aid housing 1 to be worn behind the ear. A signal-processing unit 3, likewise integrated into the hearing-aid housing 1, processes the microphone signals and amplifies them. The output signal of the signal-processing unit 3 is transferred to a loudspeaker or receiver 4, which emits an acoustic signal. If necessary, the sound is transferred to the eardrum of the equipment wearer using a sound tube, which is fixed in the auditory canal with an ear mold. A battery 5 likewise integrated into the hearing-aid housing 1 supplies the hearing aid and in particular the signal-processing unit 3 with energy.

An ear mold is an earpiece that is fitted to a shape of an auditory canal of a particular user. It is usually made of a hard plastic that maintains its shape even when the ear mold is pressed into the auditory canal. However, a flexible earpiece can also be used in place of an ear mold; the former is not specifically fitted to a user but adapts to the shape of the auditory canal when it is inserted therein as a result of the elasticity of the material from which it is produced. A special type of a flexible earpiece is a so-called dome. A dome has one or more rings bent like a dome, by which the dome is held in the auditory canal. By way of example, a flexible earpiece can be made of silicone or another soft plastic. In general, a soft material in this case means that the material deforms when it is introduced into an auditory canal and thus adapts to the auditory canal, without this causing the user pain. In the following text, both an ear mold and a flexible earpiece are generally referred to as an earpiece.

The acoustic signal from the loudspeaker or receiver is guided to the earpiece by the sound tube. There is no need for such a sound tube in an in-the-ear loudspeaker. Such a loudspeaker is connected directly to the earpiece and is introduced together with the latter into the auditory canal.

Two aspects are particularly important in the connection between the earpiece on the one hand and the sound tube or in-the-ear loudspeaker on the other hand. First of all, the earpiece must be attached securely enough so that it can again be pulled out of the auditory canal together with the sound tube or in-the-ear loudspeaker. On the other hand, it must also be simple for the user to be able to detach the earpiece in order to be able to clean the earpiece. A connection satisfying these two criteria is referred to as a detachable connection in this case.

In this context it is known to connect an earpiece to a sound tube or an in-the-ear loudspeaker by a snap-fit connection. The earpiece is then shaped such that it can, for example, be pushed onto a connection element of a sound tube and can be latched thereon. Depending on whether a hard-plastic ear mold or a flexible earpiece is intended to be attached, provision must be made for a connection element with a fitting shape on the sound tube or the in-the-ear loudspeaker. The possible combinations of, firstly, sound tube or in-the-ear loudspeaker and, secondly, the different types of earpieces necessitate the provision of a corresponding number of connection types. Moreover, the different hearing devices are correspondingly handled in a different manner. More particularly, there is a difference in the force needed to detach the earpiece from the remainder of the hearing device. Such differences can make handling of the hearing device very laborious for a user.

SUMMARY OF THE INVENTION

It is accordingly an object of the invention to provide a hearing device with a detachably coupled earpiece which overcome the above-mentioned disadvantages of the prior art devices of this general type.

In the hearing device according to the invention, a sound tube or an in-the-ear loudspeaker is coupled to an earpiece, with a first connection element being detachably connected to a second connection element for this purpose. The first connection element is configured as a component of the sound tube or the in-the-ear loudspeaker. The second connection element is attached in or on the earpiece as an independent component. As a result of the second connection element of the detachable connection, i.e. the connection element for the earpiece, being provided as an independent component, the connection element can be configured independently of the material of the actual earpiece. It goes without saying that the independent component can also contain a number of component parts here.

Overall, handling of earpieces can be unified during the coupling thereof to a hearing device in the hearing device according to the invention. More particularly, this can allow a user always to pull the earpiece with the same amount of necessary force in order to release the second connection element from the first connection element, regardless of whether the earpiece is an ear mold or a flexible earpiece. This advantageously simplifies handling of the hearing device by a user.

In the hearing device according to the invention, the same type of connection elements on the sound tubes and in-the-ear loudspeakers can, in particular, be used for both ear molds made of hard plastic and flexible ear pieces. The advantage resulting from this is that only one type of connection element still needs to be provided. Hence, it is sufficient to produce correspondingly larger batch sizes of the sound tubes or in-the-ear loudspeakers with a single type of connection element. This allows the production process thereof to be unified, which affords the possibility of reducing the production costs.

A single embodiment of a certain type of earpiece can likewise be produced in correspondingly greater numbers. This also affords the possibility of optimizing the production method for these earpieces and hence in turn lowering the costs for producing a hearing device according to the invention.

In the hearing device according to the invention, the second connection element is preferably at least partly produced from a material that is harder than an earpiece material. More particularly, the material can be a metal or a hard plastic. The use of a comparatively hard material advantageously affords the provision of a particularly small connection element on part of the earpiece.

The first connection element is preferably connected to the second connection element by a snap-fit connection and/or a screw connection. This advantageously allows a user to detach the two connection elements from one another with little effort. At the same time, these connections also afford the possibility of transmitting a sufficiently large force onto the earpiece such that the latter can be pulled out of the auditory canal without the connection elements detaching from one another in the process.

A further advantageous development of the hearing device according to the invention emerges from the first connection element having a connector for the conduction of sound and the second connection element having a corresponding socket into which the connector has been snapped in order to connect the two connection elements. Here, a connector describes a pipe that can, for example, be attached to one end of a sound tube. Such a sound connector can also be provided in an in-the-ear loudspeaker for guiding sound, which was generated in the interior of the loudspeaker by a transducer, out of the housing. In the development of the hearing device according to the invention, the sound connector simultaneously serves as a latching element that snaps into the socket.

The basic shape of the socket and the connector is preferably rotationally symmetric. Then the connector can be rotated in the socket without this releasing the snap-fit connection.

The provision of a socket as a second, i.e. earpiece-side, connection element advantageously allows a particularly simple connection of the second connection element to the earpiece. By way of example, the socket can be adhesively bonded into a recess in the earpiece. Likewise, a connector can advantageously be connected to a sound tube or provided at an in-the-ear loudspeaker in a particularly simple fashion.

As per a further embodiment of the hearing device according to the invention, this particularly results in an advantage if the earpiece has a hole in which the second connection element, i.e. the independent component in the form of a socket, is arranged. An edge region of the socket in the second connection element then additionally has been configured to be so elastic in this embodiment that snapping of the connector into the socket is made possible by an elastic deformation of the edge region. The edge region can in this case be deformed without touching an inner wall of the hole.

In other words, the edge region is thus bent apart when the connector is inserted into the socket, in order subsequently to snap back again and thereby block the connector from independently slipping out. However, in the process the edge region can be deformed without touching the earpiece, i.e. the inner wall of the hole (i.e. the earpiece itself) does not have to deform as well. This advantageously prevents damage to the earpiece by plugging and unplugging the connector.

In a further, advantageous embodiment of the hearing device according to the invention, provision is made for the two connection elements to be configured such that they can be connected to one another by being fitted together, and/or can be detached from one another by pulling, wherein at least one of the connection elements has a surface beveled in respect of a plug-direction, determined by the connection, or a pull-direction, determined by the pulling. This avoids a sharp edge of one connection element rubbing against the other connection element when the two connection elements are fitted together or pulled apart. This advantageously prevents material abrasion, and so there is only little wear and tear of the connection elements when they are fitted together and detached.

A further aspect of the invention relates to an earpiece device for a hearing device. The earpiece device according to the invention has a connection element, by which the earpiece device can be coupled to a sound tube or an in-the-ear loudspeaker. Here the connection element is attached on or in a base body of the earpiece device as an independent component. An advantage resulting from the earpiece device according to the invention is that the base body thereof can be configured independently of the type of sound tube or in-the-ear loudspeaker to which the earpiece device should later be coupled. Only attaching a corresponding connection element to the base body fixes to what the earpiece device can be coupled. It is therefore unnecessary to provide different base bodies in order to be able to equip different hearing devices with earpieces. One type of base body can be produced in correspondingly greater numbers. This affords the possibility of unifying many production steps and thus reducing the production costs of the earpiece device.

It is likewise possible, independent of a material or a shape of the base body, to select the independent component as a connection element such that a predetermined force is required to release the earpiece device from the hearing device. The advantage resulting from this is that both flexible earpieces and ear molds for being coupled to a sound tube or an in-the-ear loudspeaker can be handled in the same fashion. The independent component can be composed of a number of component parts, like in the hearing device according to the invention.

Other features which are considered as characteristic for the invention are set forth in the appended claims.

Although the invention is illustrated and described herein as embodied in a hearing device with a detachably coupled earpiece, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
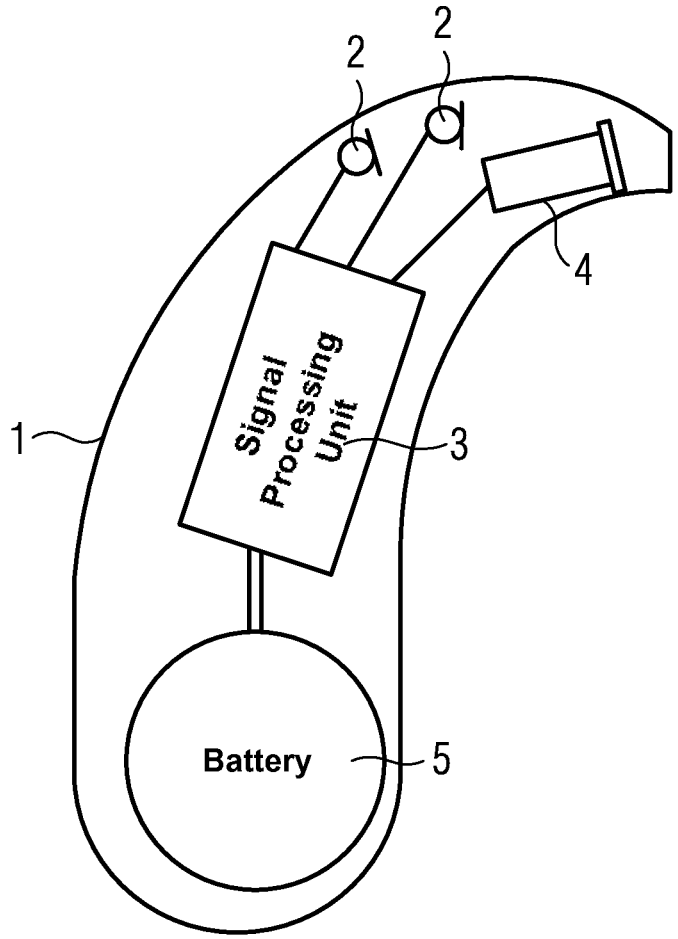
FIG. 1 PRIOR ART
FIG. 1 is a diagrammatic illustration of a behind-the-ear hearing aid without a sound tube and earpiece according to the prior art.
Figure 2:
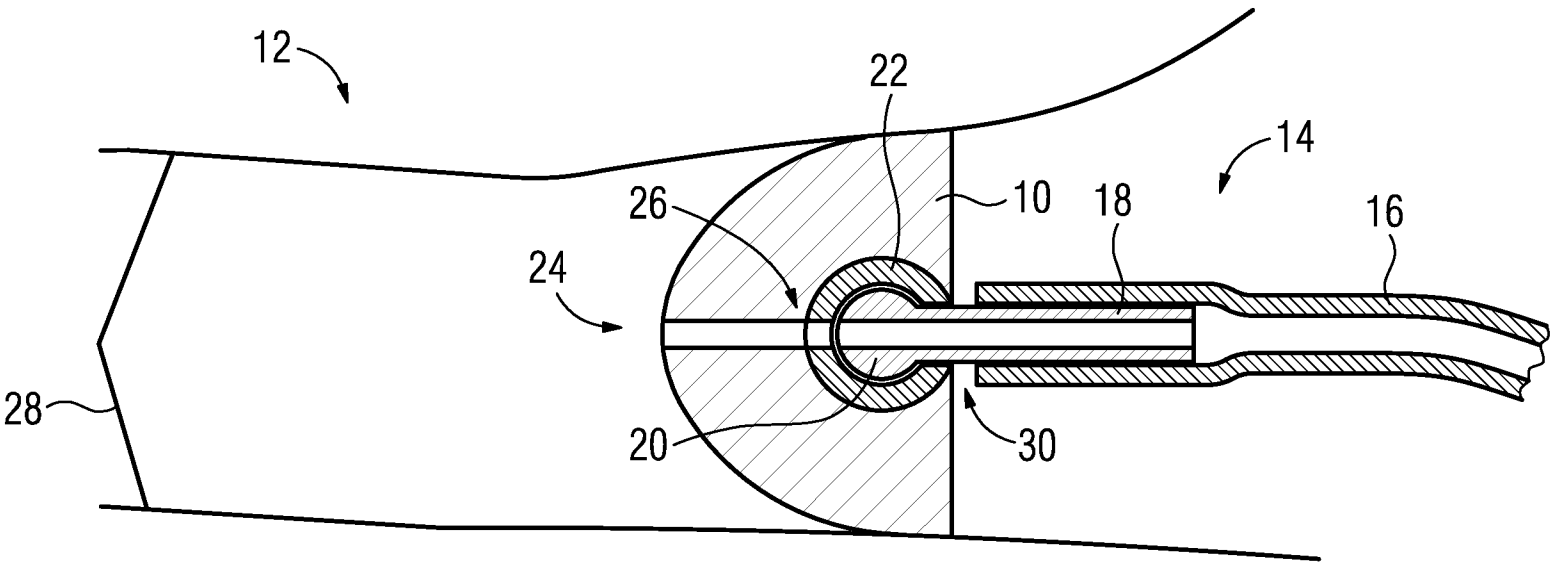
FIG. 2 is a diagrammatic, longitudinal sectional view of a sound tube with an earpiece coupled thereto, wherein the sound tube and the earpiece belong to a hearing aid as per a first embodiment of the hearing device according to the invention.

Referring now to the figures of the drawing in detail and first, particularly, to FIG. 2 thereof, there is shown an earpiece 10, which is plugged into an auditory canal 12 of a user. The earpiece 10 is made of soft and elastic silicone. An outer shape of the earpiece 10 has adapted to the shape of the auditory canal 12 when it was inserted therein. The earpiece 10 is part of a behind-the-ear hearing aid (not illustrated in any more detail), which registers a sound signal from the surroundings of the user and generates it as an amplified sound signal by a receiver. The amplified sound signal is guided to the earpiece 10 via a sound tube 14.

The sound tube 14 consists of a plastic tube 16, which is plugged onto a pipe 18. The sound tube 14 is coupled to the earpiece 10 via the pipe 18. Here, a spherical end 20 of the pipe 18 is inserted into a capsule 22, which has been adhesively bonded into a recess in the earpiece 10. The capsule 22 is an independent component. It can be formed from metal or a plastic. The pipe 18 is a first connection element and the capsule 22 is a second connection element of a detachable connection.

A through-hole 24 is formed in the earpiece 10. It opens into a hole 26 in the capsule 22. The amplified sound, generated by the receiver of the hearing aid, reaches the spherical end 20 of the pipe 18 via the plastic tube 16 and the pipe 18. The pipe 18 is held in the capsule 22 such that an outlet opening of the pipe 18 at the spherical end 20 thereof lies opposite the hole 26. The amplified sound therefore reaches the through-hole 24 from the spherical end 20 through the hole 26. From there, the sound enters the auditory canal 12 from the earpiece 10 and finally reaches an eardrum 28 of the user.

Before the users placed the earpiece 10 into the auditory canal 12, they plugged the earpiece 10 onto the pipe 18 without external aid. To this end, they pressed the spherical end 20 against an opening 30 in the capsule 22. In the process, the capsule 22 deformed resiliently in an elastic fashion such that the diameter of the opening 30 increased and, finally, the spherical end 20 snapped into the capsule 22. The opening 30 then was again reduced to its original diameter. Hence, the spherical end 20 is securely seated in the capsule 22. Thus, the earpiece 10 can be pulled out of the auditory canal 12 on the sound tube 14.

Figure 3:
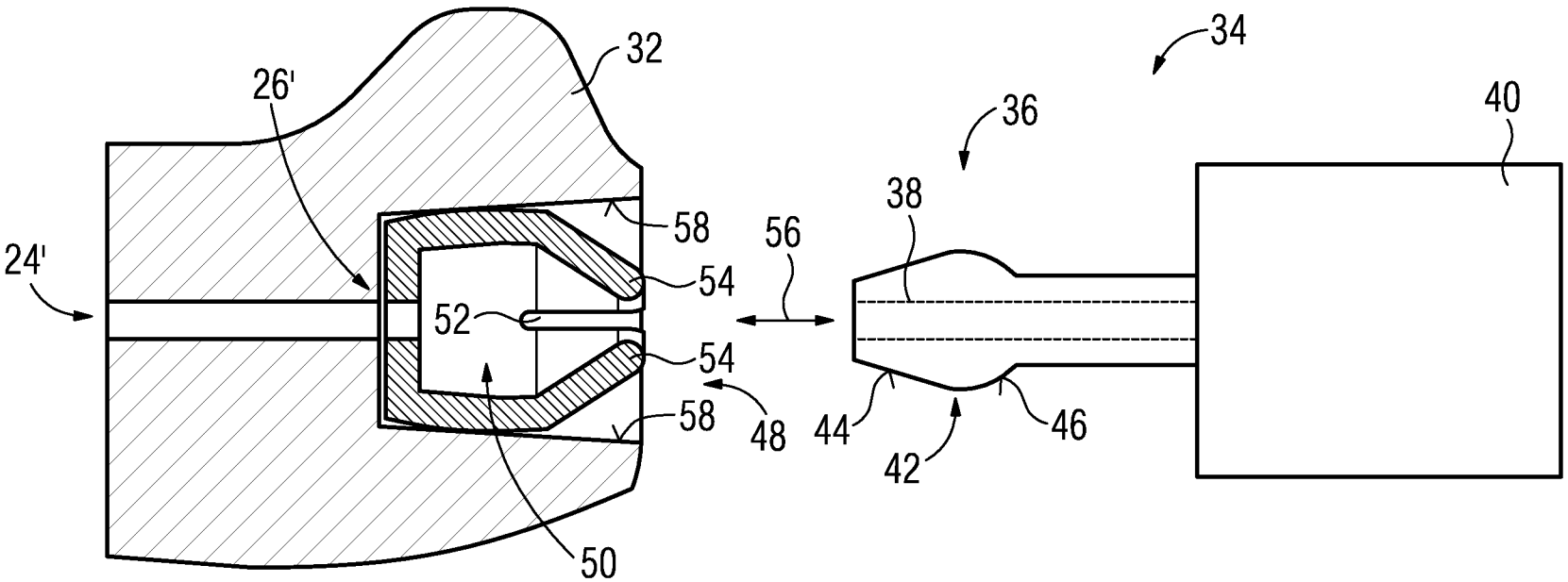
FIG. 3 is a diagrammatic, longitudinal sectional view of an ear mold and an in-the-ear loudspeaker, which are both components of the hearing aid as per a second embodiment of the hearing device according to the invention.

FIG. 3 shows a longitudinal section through an ear mold 32. The ear mold 32 is part of a hearing aid in which an amplified sound can be produced by an in-the-ear loudspeaker 34. The loudspeaker 34 is attached to a further part of the hearing aid by cables (not illustrated).

The loudspeaker 34 has a sound connector 36, which, overall, has the shape of a pipe. There is a sound canal 38 in the interior of the sound connector 36. By way of example, the sound connector 36 can be made of steel. At an end of the sound connector 36 distant from a housing 40 of the loudspeaker 34, the sound connector has a bead 42. A diameter of the sound connector 36 is greater in the region of the bead 42 than in a region between the bead 42 and the housing 40. The bead 42 forms a front bevel 44 and a rear bevel 46, wherein the specification "front" and "rear" in this case means a position of the respective bevel in respect of the ear mold 32, as shown in FIG. 3.

The ear mold 32 has a blind hole 48, in which there is a socket 50. The socket 50 can be affixed in the blind hole 48 by adhesive bonding. However, it can also be held in the blind hole 48 by an interference fit or another type of mechanical connection. The socket 50 is an independent component, which can, for example, be made of metal or a hard plastic. In the region of an opening of the socket 50, the latter has a gap 52 in the illustrated example. Resilient regions 54 are formed as a result of the gap 52 on one wall of the socket 50. The resilient regions 54 can be bent apart without this damaging the socket 50. A resilient region can also be provided by another measure depending on the socket 50 material. There is a hole 26' in the wall of the socket 50 in the region of a base of the socket 50. The hole 26' opens into a through-hole 24' in the ear mold 32.

The ear mold 32 can be coupled to the housing 40 of the loudspeaker 34 by firstly the socket 50 and secondly the sound connector 36. To this end, the ear mold 32 and the loudspeaker 34 must be brought into the relative position with respect to one another as shown in FIG. 3. By subsequently pushing the resilient regions 54 of the socket 50 onto the front bevel 44 of the bead 42 along a plug-in/out direction 56, a force is exerted onto the resilient regions 54 by the front bevel 44, by which force the resilient regions are bent apart. This also leads to a dilation of the gap 52. A space is provided in the ear mold 32 between an inner wall 58 of the blind hole 48 and the resilient regions 54. As a result, the resilient regions 54 can move apart when the bead 42 is inserted into the socket 50 without also having to deform the ear mold 32 in the process.

The bead 42 can be completely inserted into the socket. The resilient regions 54 snap together again and then hold the bead 42 with the rear bevel 46. In the detachable connection formed thus, the sound connector 36 is a first connection element and the socket is a second connection element. In order to release the connection, the sound connector 36 simply has to be pulled out of the socket 50 along the plug-in/out direction 56. As a result of their incline with respect to the plug-in/out direction 56, the front bevel 44 and the rear bevel 46 ensure that abrasion of the resilient regions 54 of the socket 50, and of the bead 42 is particularly low during the plugging and unplugging.

If the loudspeaker 34 is coupled to the ear mold 32, the two can be introduced into an auditory canal together. A sound generated by a sound transducer in the interior of the housing 40 can then be guided to an eardrum of the user through the sound canal 38, the hole 26' and the through-hole 24'.

Figure 4:
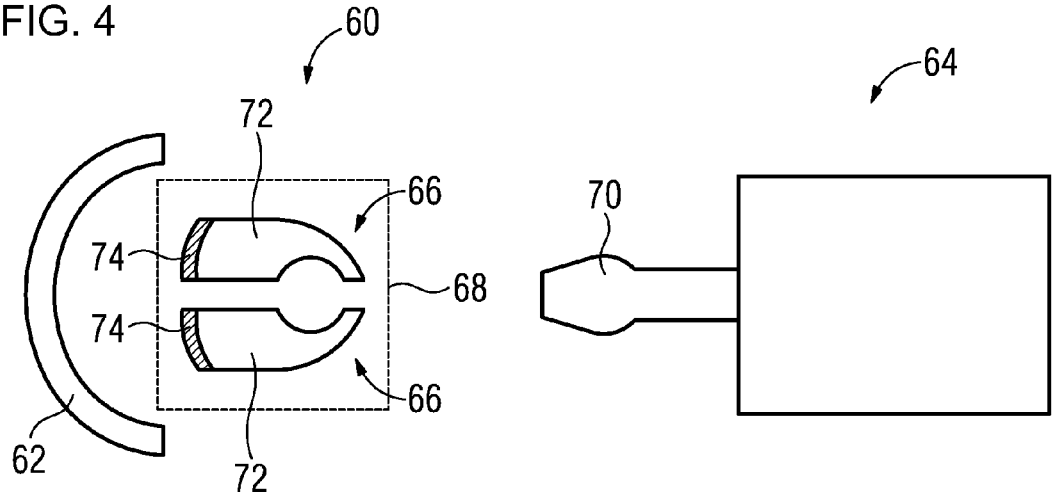
FIG. 4 is a diagrammatic illustration of a dome and a two-part connection element, all three parts are components of a third embodiment of the earpiece device according to the invention.

FIG. 4 shows an earpiece device 60 in the unmounted state. The earpiece device 60 contains a dome 62 made of a soft plastic. The dome can be closed or open, i.e. it can be suitable for closing off an auditory canal in soundproof fashion or it can allow air exchange through openings. In order to be able to couple the dome 62 to an in-the-ear loudspeaker 64, provision is made in the earpiece device 60 for attaching two socket halves 66 to the dome 62. In the fixed state, a socket 68 is then formed by the two socket halves 66, in which socket a sound connector 70 of the in-the-ear loudspeaker 64 can be held by a detachable snap-fit connection. Here the sound connector 70 is a first connection element and the socket 68 is a second connection element. The snap-fit connection corresponds to the connection already discussed previously in conjunction with FIGS. 2 and 3.

Each socket half 66 has a hard preform 72, to which a connection layer 74 is respectively attached. The hard preform 72 can in each case be produced from e.g. metal or a hard plastic. The connection layer 74 in each case allows a preform 72 to be attached to the dome 62. This can be brought about by adhesive bonding or else by a different, suitable type of connection. With respect to the dome 62, the socket 68 formed by the socket halves 66 constitutes an independent component.

The preforms 72 are selected in accordance with a shape of the sound connector 70. This affords the possibility of coupling the dome 62 to the sound connector 70.

Figure 5:
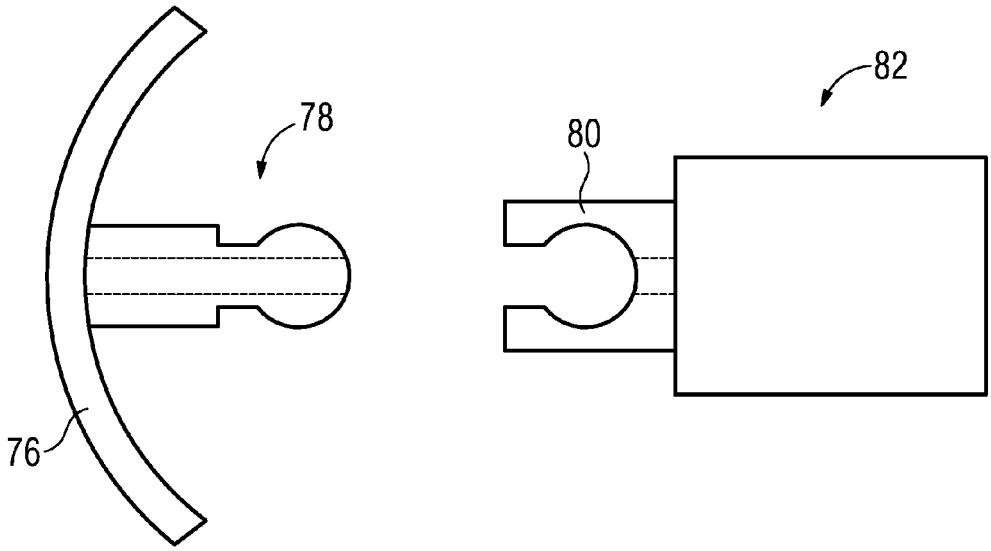
FIG. 5 is a diagrammatic, illustration of an earpiece and an in-the-ear loudspeaker of a hearing aid as per a fourth embodiment of the hearing device according to the invention.

FIG. 5 shows a dome 76 with a connector 78 attached thereto. The connector 78 has been produced as an independent component. The dome 76 has the same shape as the dome 62 shown in FIG. 4. The connector 78 can be plugged into a socket 80 of an in-the-ear loudspeaker 82. The socket 80 and the connector 78 then form a detachable snap-fit connection, with the socket 80 constituting a first connection element and the connector 78 constituting a second connection element of the snap-fit connection.

Comparing the examples from FIGS. 4 and 5 shows that the same type of dome can be used for the in-the-ear loudspeakers 64 and 82. Hence, there is no need to produce an individual type of dome for each loudspeaker.

The examples show how a connection of a sound tube or an in-the-ear loudspeaker is made possible in a hearing device by a detachable connection of two hard components. Here a soft earpiece, for example a flexible dome, is connected to one of the hard components by mechanical means. This can be brought about by adhesive bonding, mechanical plugging or another type of connection. Due to the fact that plug-in components, e.g. the sound connectors, have a rounded shape or beveled surfaces, the service life of the components can be increased.

Hearing devices according to the invention allow for the separate production of soft components and hard components and the subsequent arbitrary combining thereof. On the one hand, this can simplify the production of the parts. On the other hand, individual parts can be combined in various ways and hence a greater variety of ear adaptors can be provided. The device according to the invention allows for a snap-fit element, i.e. a plug from a snap-fit connection, to be attached to a loudspeaker side or a side of a flexible earpiece. A screw connection or another mechanical joining process can also be provided in place of a plug for a snap-fit connection for coupling an earpiece to a sound tube or an in-the-ear loudspeaker. Since the unified connection is brought about between the detachably connected parts by means of hard components, the components can have a smaller configuration, as a result of which the range of the ear canals to be supplied is broadened.

The invention claimed is:

1. A hearing device, comprising:

an ear piece having a hole formed therein;

an element, selected from the group consisting of a sound tube and an in-the-ear loudspeaker, coupled to said earpiece;

a first connection element configured as a component of said element, said first connection element having a connector for conduction of sound, said connector having a surface beveled in respect of a plug-direction and further beveled in respect of a pull-out direction; and a second connection element disposed in said hole of said ear piece, said first connection element detachably connected to said second connection element, said second connection element attached in or on said earpiece as an independent component, said second connection element having a socket into which said connector of said first connection element is snapped-in to connect said first and second connection elements, said socket of said second connection element having an edge region configured to be elastic so that snapping of said connector into said socket is made possible by an elastic deformation of said edge region, wherein said edge region can be deformed without touching an inner wall of said hole.

2. The hearing device according to claim 1, wherein said second connection element is at least partly produced from a material that is harder than an earpiece material.

3. The hearing device according to claim 1, wherein said first connection element is connected to said second connection element by at least one of a snap-fit connection or a screw connection.

4. The hearing device according to claim 1, wherein:

said first and second connection elements are configured to be connected to one another by being fitted together and to be detached from one another by pulling.

* * * * *